US006834408B1

(12) United States Patent
Chen

(10) Patent No.: US 6,834,408 B1
(45) Date of Patent: Dec. 28, 2004

(54) METHOD OF MAKING A SHOE

(75) Inventor: Eddie Chen, Taichung (TW)

(73) Assignee: C2 Corporation, Taichung (TW)

( * ) Notice: Subject to any disclaimer, the term of this patent is extended or adjusted under 35 U.S.C. 154(b) by 0 days.

(21) Appl. No.: 10/456,261

(22) Filed: Jun. 6, 2003

(51) Int. Cl.[7] ..... A43B 13/28
(52) U.S. Cl. ..... 12/142 T; 36/21; 36/22 R
(58) Field of Search ..... 36/16, 19 R, 21, 36/22 R; 12/142 RS, 142 T

(56) References Cited

U.S. PATENT DOCUMENTS 4,001,954 A * 1/1977 Taylor, Jr. ..... 36/16
4,852,275 A * 8/1989 Bianchini et al. ..... 36/102
5,421,050 A * 6/1995 Laganas ..... 12/142 T
6,029,301 A 2/2000 Issler et al. ..... 12/142 B
6,055,745 A * 5/2000 Endoh ..... 36/12
6,484,420 B1 * 11/2002 Chi et al. ..... 36/12

* cited by examiner

*Primary Examiner*—Ted Kavanaugh
(74) *Attorney, Agent, or Firm*—Ladas & Parry

(57) ABSTRACT

A method of making a shoe comprises sewing a rear stitching margin of a rear section of an upper to a midsole, gluing and attaching a rear section of an outsole to the midsole and the rear stitching margin, and stitching a front stitching margin of a front section of the upper directly to a front section of the outsole. The method is simple since it dispenses with use of a heel lasting machine which requires complicated processing steps. The method provides a shoe with good flexibility at a front section of the shoe and sufficient support at a rear section of the shoe.

20 Claims, 10 Drawing Sheets

METHOD OF MAKING A SHOE

BACKGROUND OF THE INVENTION

1. Field of the Invention

This invention relates to a method of making a shoe, more particularly, a method in which a front portion of an upper is stitched directly to an outsole and a rear portion of the upper is sewn to a midsole.

2. Description of the Related Art

A typical shoe construction, well known as the Opanka construction, includes an upper having a bottom open end stitched directly to the periphery of an outsole without any midsole attached to the upper. While such a shoe construction provides good flexibility, due to the absence of the midsole, it does not have sufficient strength at its heel region so that it can be deformed easily, especially when the user who wears the shoe takes part in dynamic activities.

In order to alleviate the aforesaid problem, an improved method of constructing a shoe is suggested in U.S. Pat. No. 6,029,301. The method includes stitching the bottom end of a front portion of an upper to the outer peripheral end of a front portion of an outsole through pre-punched needle holes provided in the front portions of the upper and the outsole, and lasting the bottom end of a rear portion of the upper to a midsole by means of a heel lasting machine followed by the step of securing the midsole to the outsole. The shoe constructed by this method not only provides enhanced strength at the heel region to alleviate the deformation problem but also possesses good flexibility. However, inconveniences are caused due to the use of the heel lasting machine. In addition, since the upper is made of a flexible material, the heel lasting machine would deform the front portion of the upper and would cause misalignment of the pre-punched needle holes in the upper and the outsole if the front portion of the upper is stitched to the outsole after the rear portion is lasted. To avoid the misalignment problem, the stitching operation is carried out prior to the lasting operation by using a complicated hinged last which has a stationary front section and a movable heel section. The use of such a hinged last complicates the method of constructing the shoe.

SUMMARY OF THE INVENTION

An object of the present invention is to provide a simple method of making a shoe which eliminates the problem encountered in the prior art disclosed in the above-mentioned U.S. Patent.

According to the present invention, a method of making a shoe, comprises: (a) preparing an upper which includes an open top end, an open bottom end, an enclosing wall extending from the top end to the bottom end, the enclosing wall having a front section and a rear section, the front section having a front stitching margin, the rear section having a rear stitching margin; (b) preparing an outsole having a front section and a rear section; (c) preparing a midsole including at least a heel section; (d) stitching the rear stitching margin to the midsole; (e) inserting a last into the upper; (f) gluing and attaching the rear section of the outsole to the rear stitching margin and the midsole; and (g) stitching the front stitching margin to the front section of the outsole.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
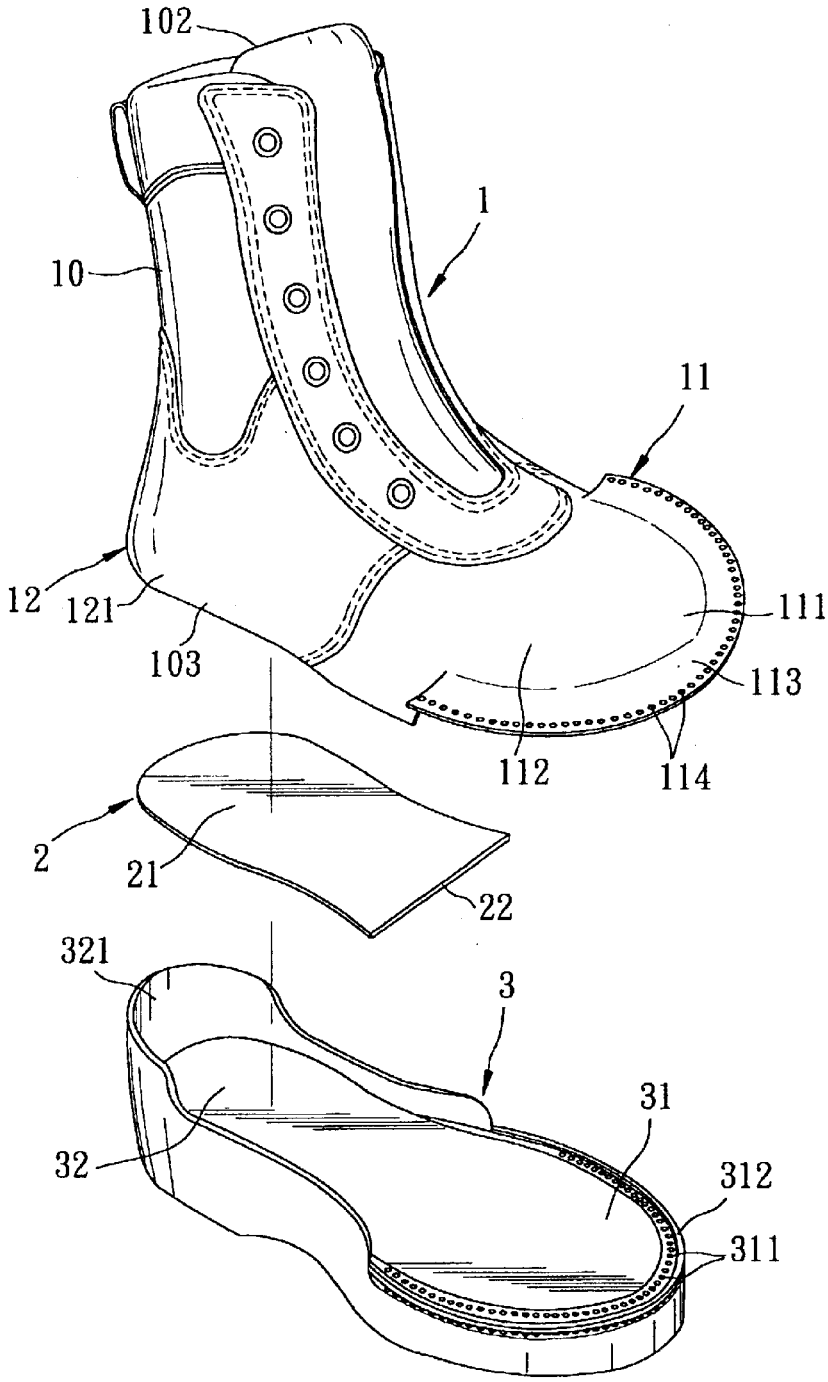
FIG. 1 is a perspective view illustrating an upper, a midsole and an outsole to be assembled in a first preferred embodiment of a method of making a shoe according to the present invention.

Before the present invention is described in greater detail, it should be noted that same reference numerals have been used to denote like elements throughout the specification.

The first preferred embodiment of a method according to the present invention includes preparing an upper 1, a midsole 2 and an outsole 3 which are shown in FIG. 1.

The upper 1 is made of a soft and comfortable material such as leather or a fabric, and includes an enclosing wall 10 extending from an open top end 102 to an open bottom end 103 of the upper 1. The enclosing wall 10 includes a front section 11 which covers a toe region 111 and a metatarsal region 112, and a rear section 12 which covers a heel region. The front section 11 has a front stitching margin 113 that extends from the left side of the metatarsal region 112 to the right side of the metatarsal region 112 and around the toe region 111. A series of needle holes 114 are provided in the front stitching margin 113 through a punching process.

The midsole 2 is formed as a midsole half which has a heel region 21 and a front edge 22 which will extend at the rear of the metatarsal region 112 after the midsole 2 is assembled with the upper 1. While the midsole half 2 is used in this embodiment, it may be substituted with a full length midsole that has heel, metatarsal and toe regions.

Figure 5:
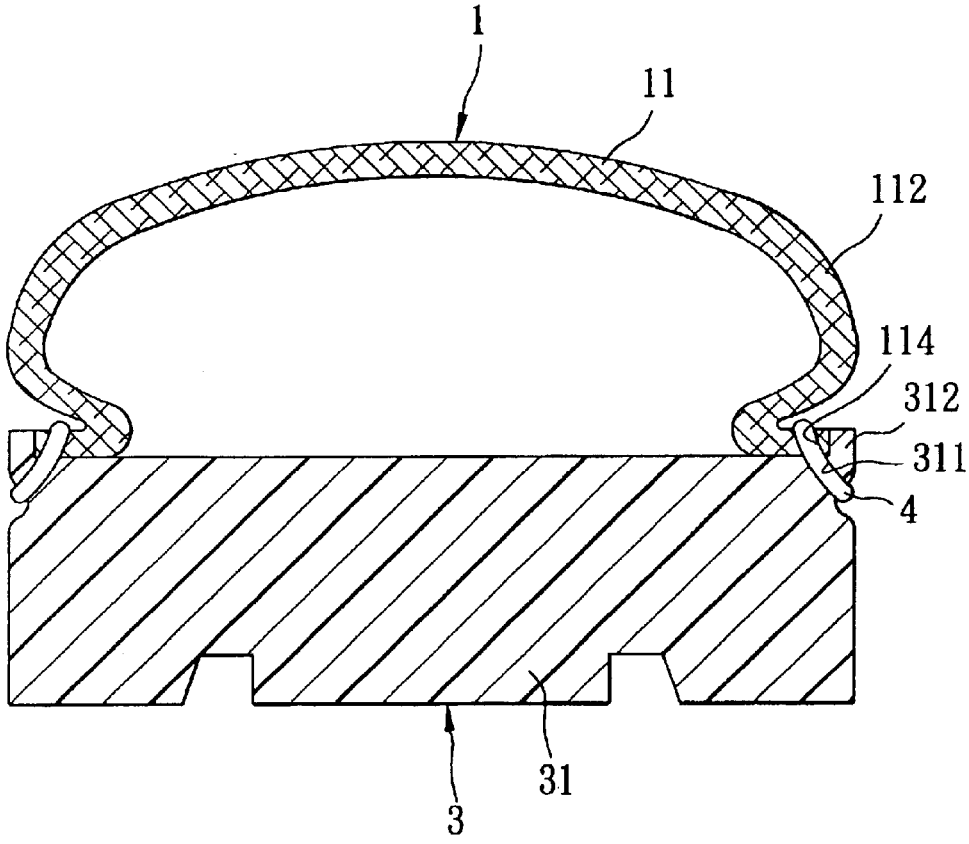
FIG. 5 is a sectional view taken along line 5—5 of FIG. 2.

The outsole 3 has a front section 31 corresponding to the front section 11 of the upper 1 and a rear section 32 corresponding to the rear section 12 of the upper 1. The front section 31 is provided with a plurality of needle holes 311 in a front peripheral upward flange 312. The positions of the needle holes 311 correspond respectively to the needle holes 114 in the front stitching margin 113. Each needle hole 311 extends from the upper side of the peripheral upward flange 312 to the lower side thereof, as shown in FIG. 5. A rear peripheral flange 321 projects upward from the outer periphery of the rear section 32.

Figure 2:
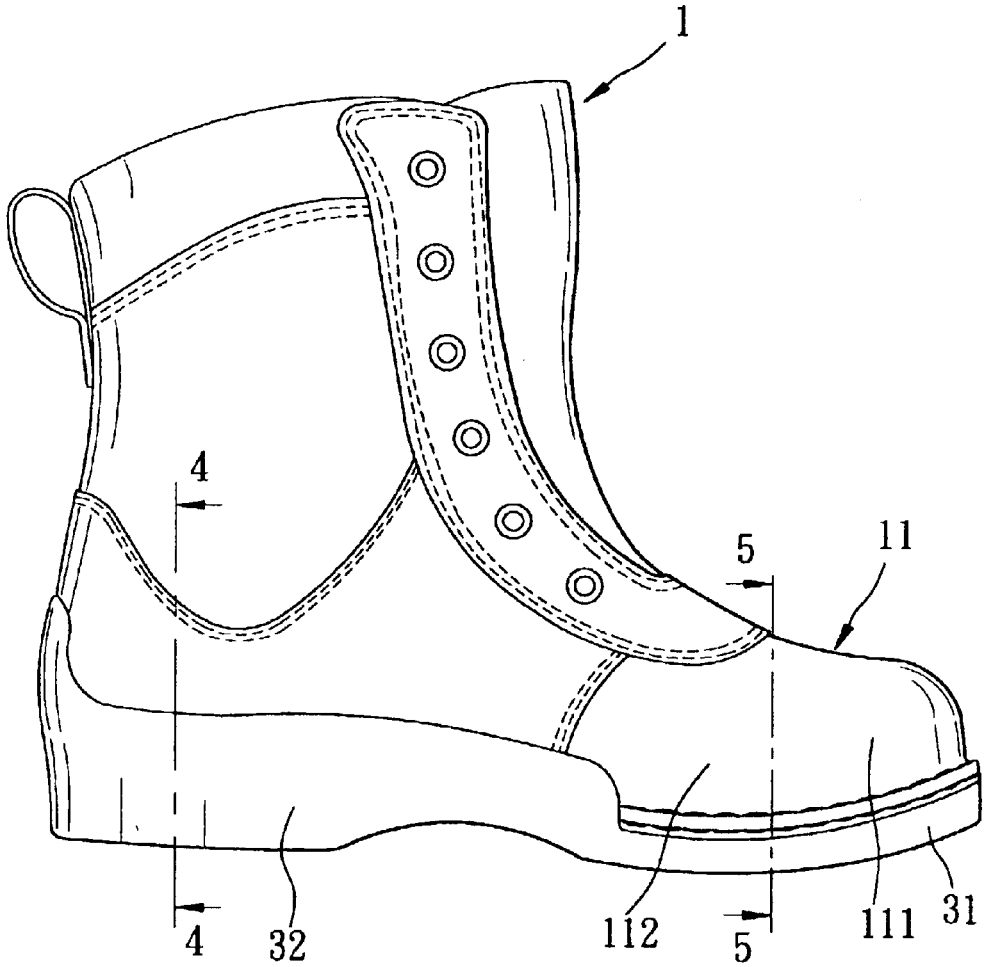
FIG. 2 is a perspective view of a shoe produced by the first embodiment.
Figure 3:
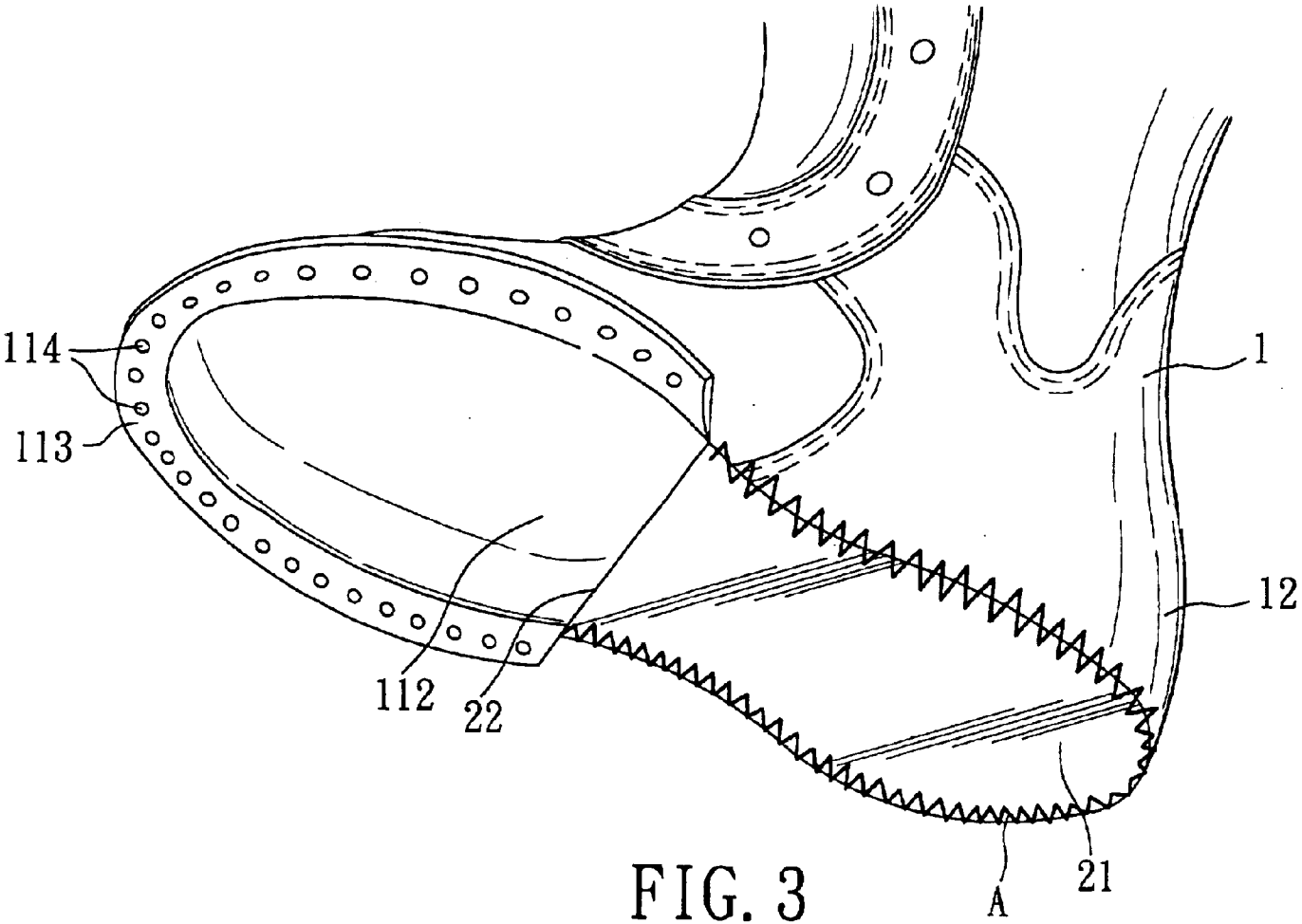
FIG. 3 is a perspective view showing that the midsole is sewn to the upper.

The method of this embodiment provides a shoe shown in FIG. 2 by assembling the upper 1, the midsole 2 and the outsole 3. In assembly, the midsole 2 is first sewn to the rear stitching margin 121 of the rear section 12 of the upper 1 along a stitching line A which extends along full length of the rear stitching margin 121. The stitching line A extends from the front edge 22 at the left side of the midsole 2 to the front edge 22 at the right side and around the heel region 21 as shown in FIG. 3. The front edge 22 of the midsole 2 extends rearwardly of the metatarsal region 112 of the upper 1.

Figure 4:
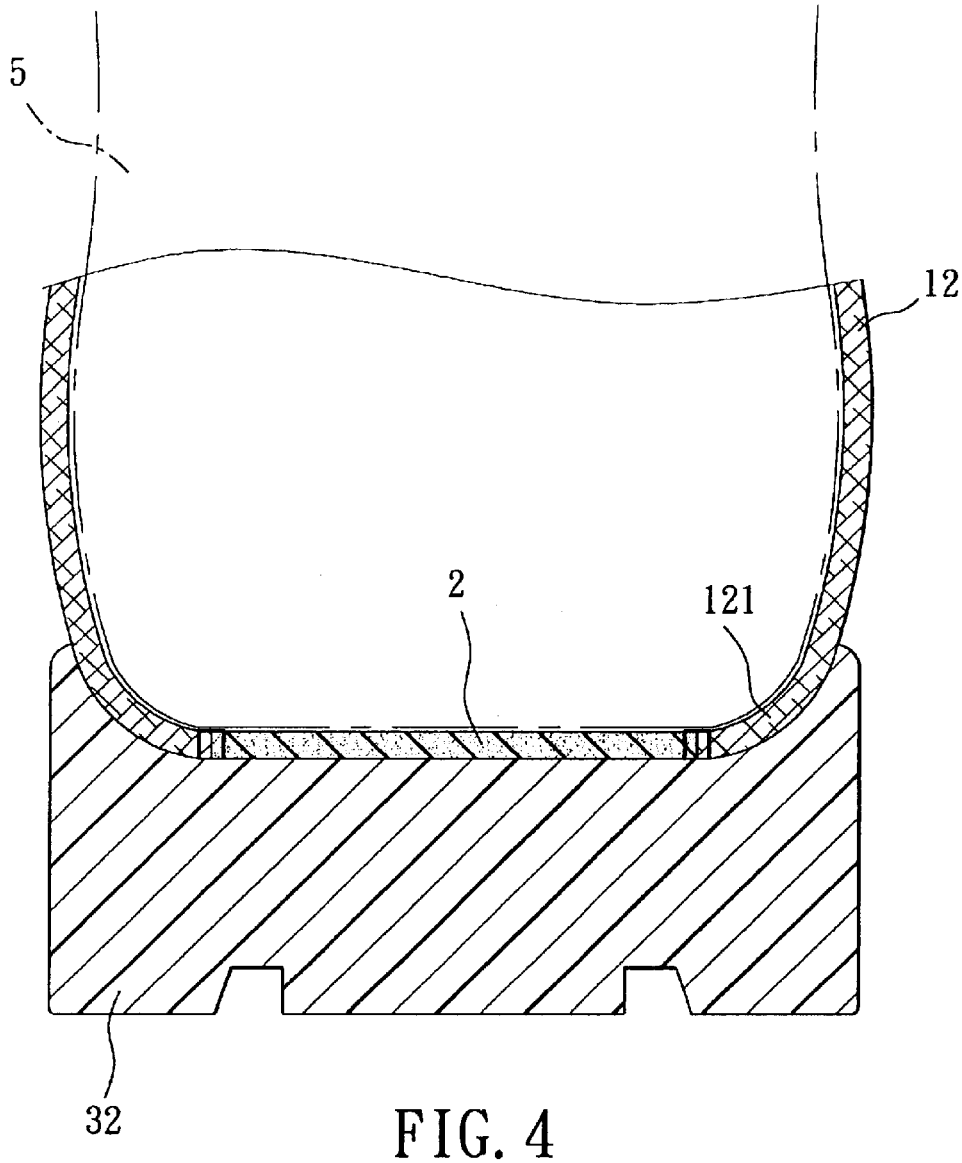
FIG. 4 is a sectional view taken along line 4—4 of FIG. 2.

After the midsole 2 is sewn to the rear section 12 of the upper 1, a last 5 is inserted into the upper 1, as shown in FIG. 4, and the rear section 32 of the outsole 3 is secured to the midsole 2 and the rear stitching margin 121 of the upper 1 through a gluing process. Subsequently, the front stitching margin 113 of the front section 11 of the upper 1 is turned outward and is stitched to the front section 31 of the outsole 3 by using a thread 4 which passes through the needle holes 114 and 311, as shown in FIG. 5.

As described above, the present invention does not utilize a heel lasting machine which is necessary in the prior art disclosed in U.S. Pat. No. 6,029,301. Instead, the present invention employs a stitching process to secure the midsole 2 to the rear section 12 of the upper 1, which permits the entire open bottom end 103 of the upper 1 to be positioned properly through a stitching machine during the stitching process. As such, no deformation problem occurs in the front section 11 of the upper 1 after the midsole 2 is sewn to the upper 1, and the needle holes 114 in the front section 11 can be easily aligned with the needle holes 311 in the outsole 3 in the following operation step. Since the process of the present invention permits the rear section 12 of the upper 1 to be sewn to the midsole 2 prior to stitching the front section 11 of the upper 1 to the outsole 3, the process is relatively simple as compared with the prior art. However, while it is preferable to stitch the front section 11 of the upper 1 to the outsole 3 after attachment of the midsole 2 to the upper 1, the present invention is not limited thereto. The sequence of the steps constituting the method of the present invention may be varied as desired.

Despite the simplified processing steps utilized in the method of the present invention, the method still can produce a shoe which has good flexibility at a front part of the shoe and sufficient strength at a rear part of the shoe.

Figure 6:
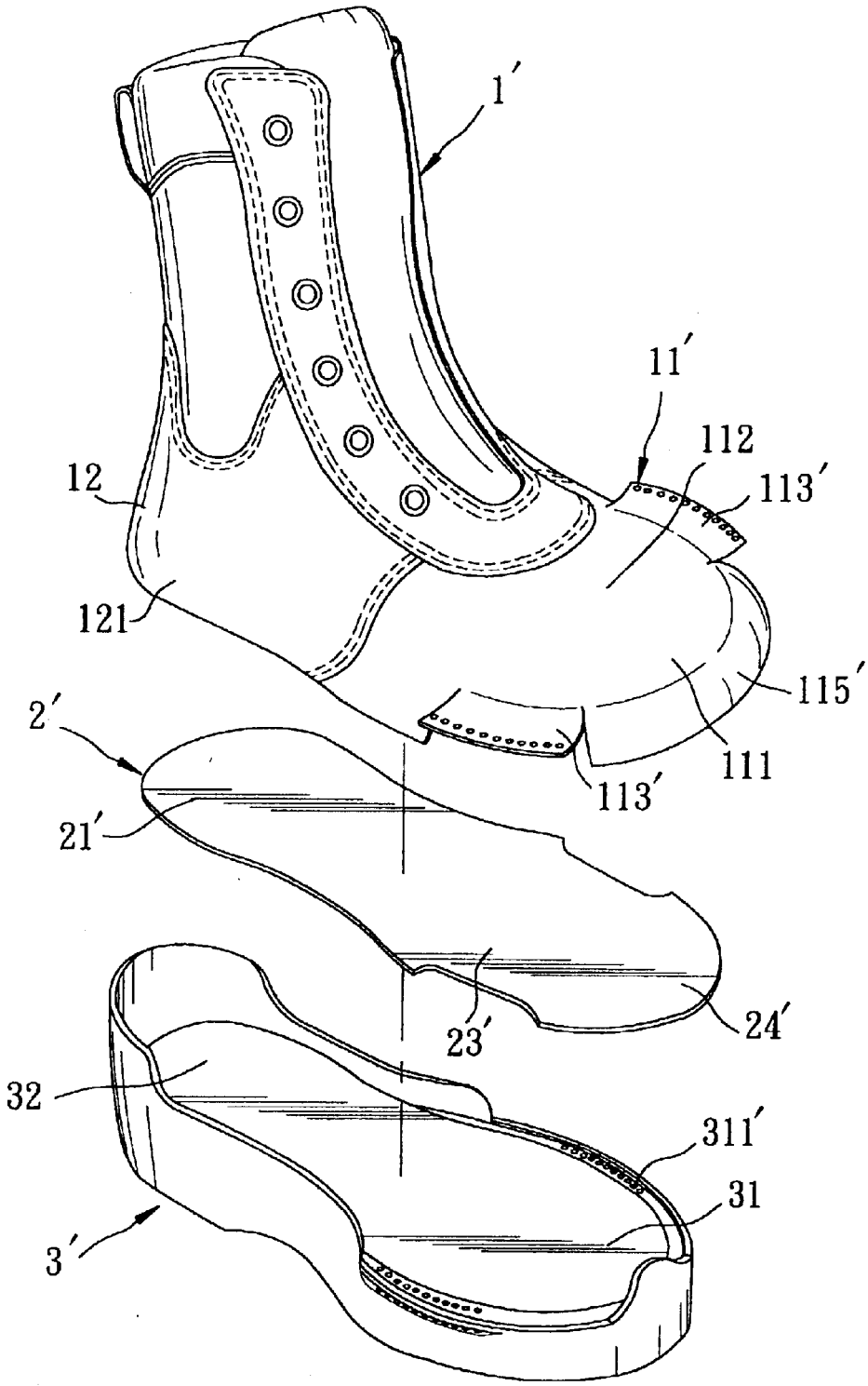
FIG. 6 is a perspective view illustrating an upper, a midsole and an outsole to be assembled in a second preferred embodiment of the present invention.
Figure 7:
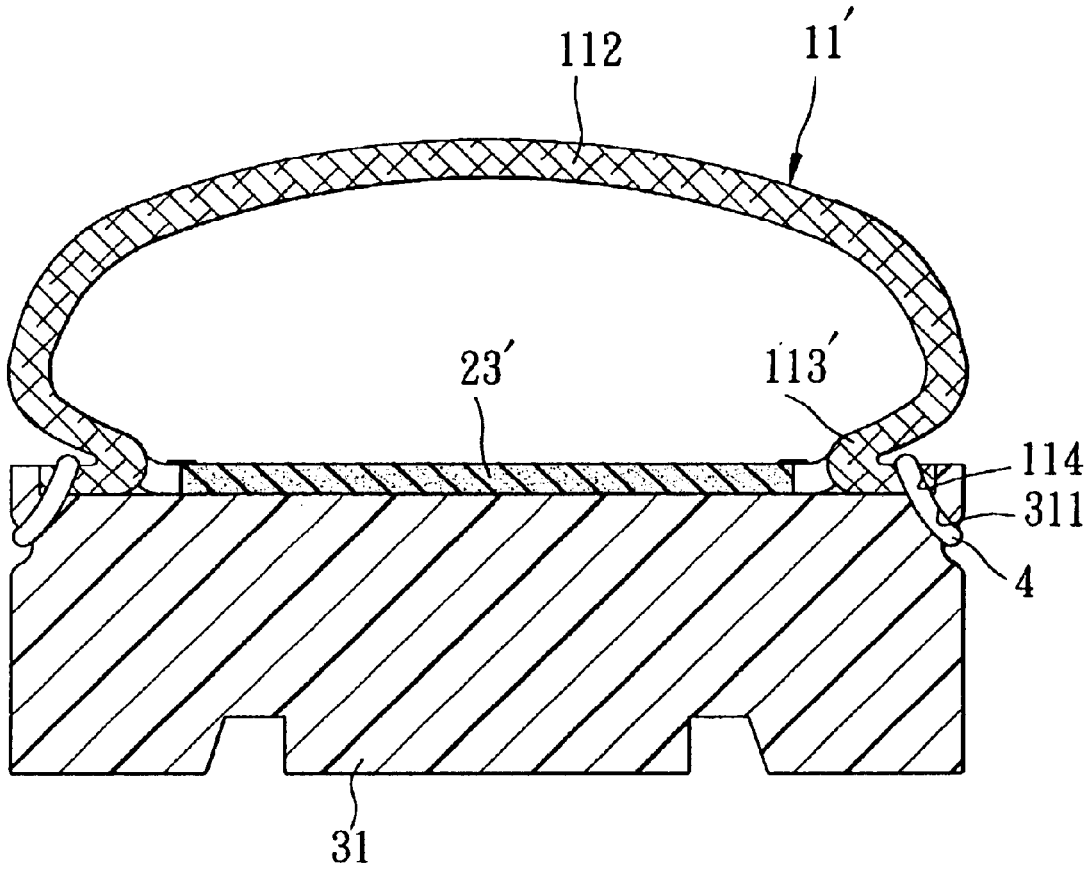
FIG. 7 is a sectional view of a shoe produced by the second embodiment.
Figure 8:
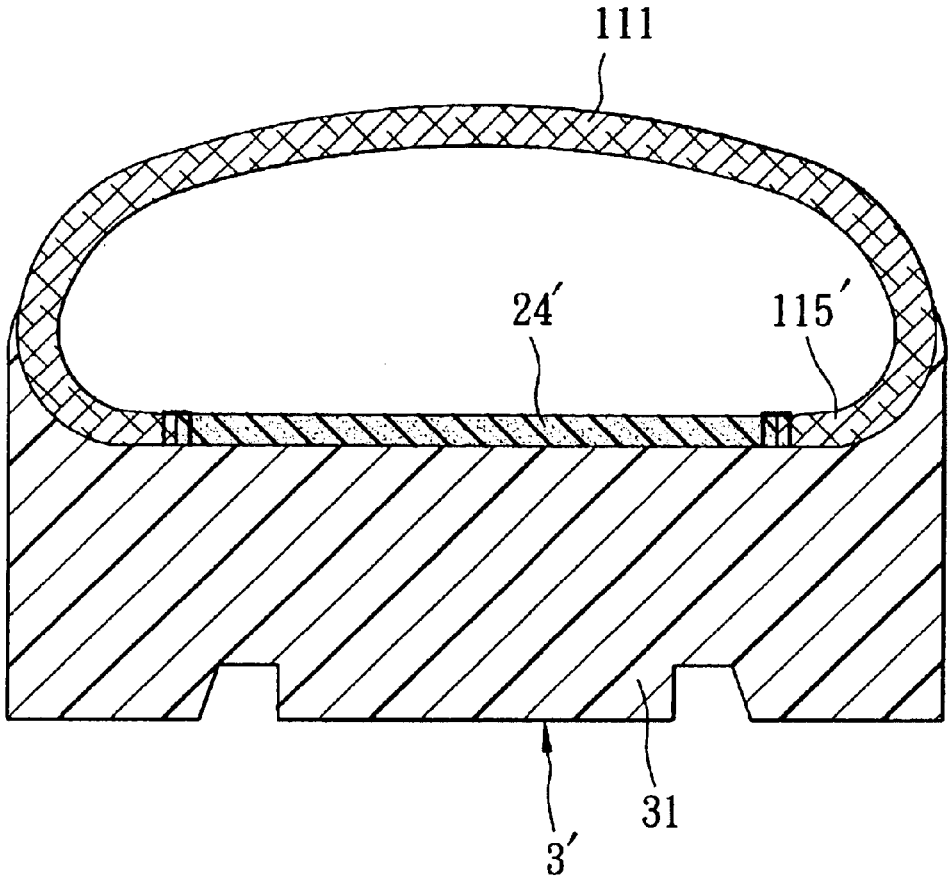
FIG. 8 is another sectional view of the shoe of FIG. 7.

The second preferred embodiment of the method according to the present invention is illustrated in FIGS. 6 to 8. This second embodiment is substantially similar to the first embodiment except that the upper 1' in this embodiment is provided with two separate front stitching margins 113' at left and right sides of the metatarsal region 112 of the upper 1', and that the midsole 2' is formed as a full length midsole which has a heel region 21', a metatarsal region 23', and a toe region 24'. The toe section 111 of the upper 1' has a stitching end 115' sewn to a peripheral end of the toe region 24' of the midsole 2'. The midsole 2' is indented at left and right sides of the metatarsal region 23' where the front stitching margins 113' are stitched to the outsole 3'. Each front stitching margin 113' is stitched to the outsole 3' at one of the left and right sides of the outsole 3'. The rear stitching margin 121 of the upper 1' is sewn to the periphery of the midsole 2' along a stitch line (not shown) which extends along full length of the rear stitching margin 121. This embodiment provides good flexibility at the metatarsal region 112 of the upper 1'.

Figure 9:
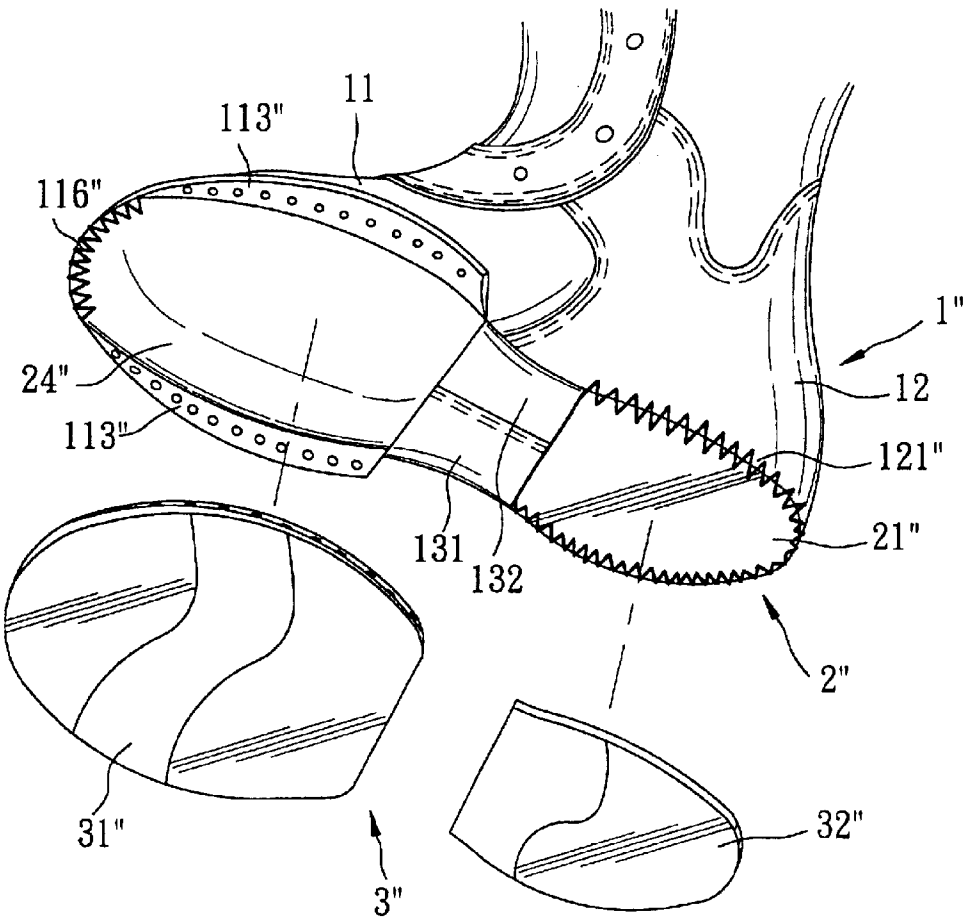
FIG. 9 is a perspective view illustrating an upper, a midsole and an outsole to be assembled in a third preferred embodiment of the present invention.
Figure 10:
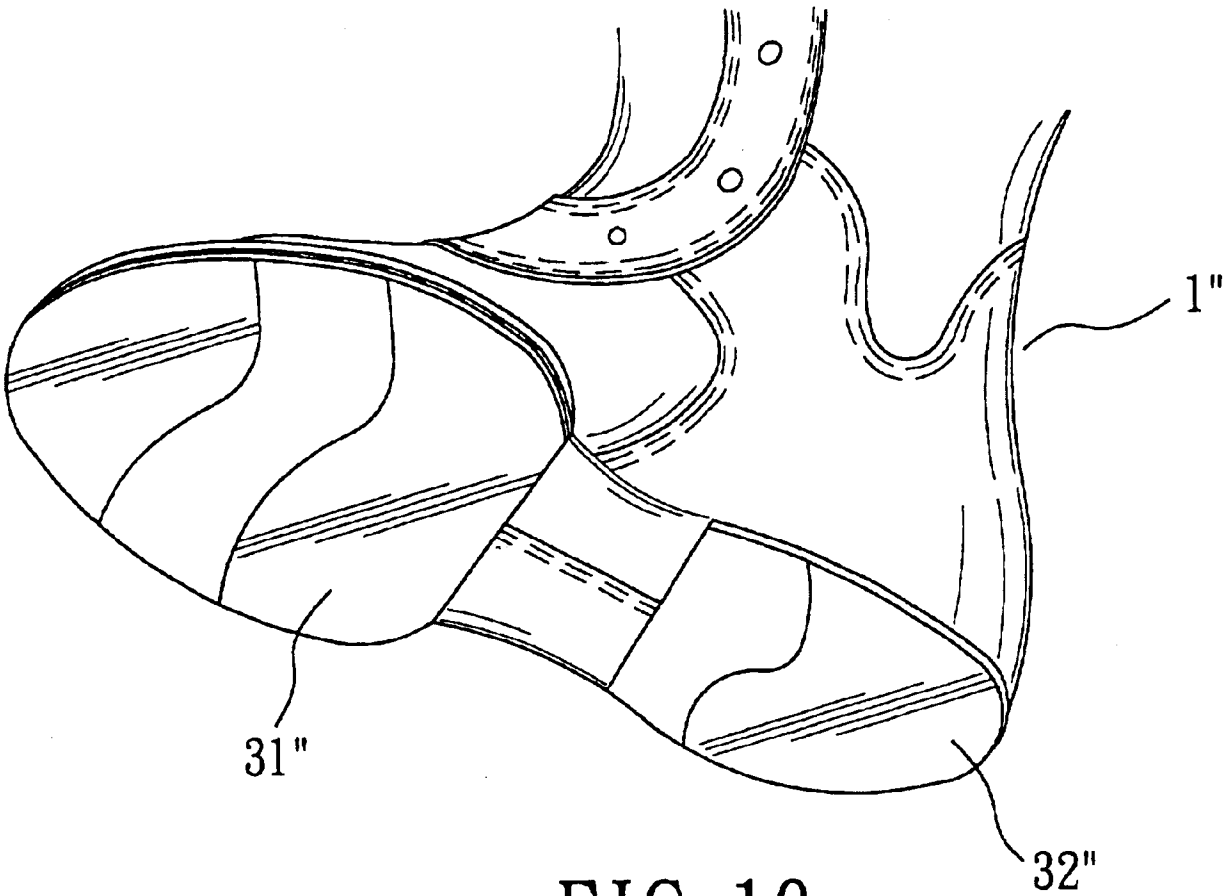
FIG. 10 is a perspective view of a shoe produced by the third preferred embodiment.

Referring to FIGS. 9 and 10, the third preferred embodiment of the method according to the present invention includes utilizing an outsole 3" and a midsole 2". This embodiment is substantially similar to the first embodiment. However, the upper 1" is additionally provided with a frontmost margin 116". Front stitching margins 113" are provided rearwardly of the frontmost margin 116" and at left and right sides of the front section 11 of the upper 1". The outsole 3" includes a front section 31" and a rear section 32" which are formed as separate pieces. The midsole 2" is provided with a rear section 21" and a front section 24" which are also formed as separate pieces. The rear stitching margin 121 of the upper 1" is sewn to the rear section 21" of the midsole 2". The front section 11 of the upper 1" is sewn to the midsole 2" only at the frontmost margin 116". Front stitching margins 113" of the upper 1" are turned outward and are stitched to the left and right sides of the outsole 3" at corresponding positions. The upper 1" is further provided with left and right intermediate stitching margins 131, 132 which are turned inward and sewn together.

The method of this embodiment provides additional flexing characteristics at the intermediate part of the upper 1" as compared with the first and second embodiments. Of course, an additional support plate maybe provided below or above the intermediate stitching margins 131, 132 of the upper 1" in a conventional manner for reinforcing purposes.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A method of making a shoe, comprising:

(a) preparing an upper which includes an open top end, an open bottom end, an enclosing wall extending from said top end to said bottom end, said enclosing wall having a front section and a rear section, said front section having a front stitching margin, said rear section having a rear stitching margin;

(b) preparing an outsole having a front section and a rear section;

(c) preparing a midsole including at least a heel section;

(d) stitching said rear stitching margin to said midsole;

(e) inserting a last into said upper;

(f) gluing and attaching said rear section of said outsole to said rear stitching margin and said midsole; and (g) stitching said front stitching margin to said front section of said outsole wherein steps (d), (e), (f) and (g) are carried out sequentially.

2. The method as claimed in claim 1 wherein step (a) includes providing needle holes in said front stitching margin, and step (c) includes providing said front section of said outsole with needle holes corresponding to said needle holes in said front stitching margin.

3. The method as claimed in claim 2, wherein step (g) includes turning outward said front stitching margin before stitching said front stitching margin.

4. The method as claimed in claim 1, wherein step (a) includes providing said front section of said upper with a toe region and a metatarsal region, said front stitching margin extending from a left side of said metatarsal region to a right side of said metatarsal region and around said toe region.

5. The method as claimed in claim 4, wherein step (c) includes forming said midsole as a midsole half which has a heel region and a front edge extending at the rear of said metatarsal region of said upper.

6. The method as claimed in claim 1, wherein step (a) includes providing said front section of said upper with a toe region and a metatarsal region, said front stitching margin being provided solely at each of left and right sides of said metatarsal region of said upper.

7. The method as claimed in claim 6, wherein step (c) includes providing said midsole with a toe region, a metatarsal region and a heel region, and step (g) includes stitching said front stitching margin, which is provided at each of the left and right sides of said metatarsal region of said upper, to one of left and right sides of said outsole.

8. The method as claimed in claim 7, further comprising sewing a stitching end of said toe region to a peripheral end of said toe region of said midsole.

9. The method as claimed in claim 1, wherein step (b) includes forming said front and rear sections of said outsole, into two separate pieces, step (c) including providing said midsole with a front section corresponding to said front section of said outsole and a rear section corresponding to said rear section of said midsole, and forming said rear section of said midsole as a separate piece from said front section of said midsole.

10. The method as claimed in claim 9, wherein step (a) includes providing said front section of said upper with a frontmost margin, said front stitching margin being provided at each of left and right sides of said front section of said upper and rearwardly of said frontmost margin, the method further comprising sewing said frontmost margin to said front section of said midsole.

11. The method as claimed in claim 10, wherein step (a) further includes providing left and right intermediate stitching margins between said front and rear stitching margins, the method further comprising turning inward and sewing together said left and right intermediate stitching margins.

12. A method of making a shoe, comprising:

(a) preparing an upper which includes an open top end, an open bottom end, an enclosing wall extending from said top end to said bottom end, said enclosing wall having a front section and a rear section, said front section having a front stitching margin, said rear section having a rear stitching margin;

(b) preparing an outsole having a front section and a rear section; and (c) preparing a midsole including at least a heel section; and then sequentially:

(i) stitching said rear stitching margin to said midsole;

(ii) inserting a last into said upper;

(iii) gluing and attaching said rear section of said outsole to said rear stitching margin and said midsole; and (iv) stitching said front stitching margin to said front section of said outsole.

13. The method as claimed in claim 12, wherein preparing the upper includes providing needle holes in said front stitching margin, and preparing the midsole includes providing said front section of said outsole with needle holes corresponding to said needle holes in said front stitching margin.

14. The method as claimed in claim 12, wherein preparing the upper includes providing said front section of said upper with a toe region and a metatarsal region, said front stitching margin extending from a left side of said metatarsal region to a right side of said metatarsal region and around said toe region.

15. The method as claimed in claim 14, wherein preparing the midsole includes forming said midsole as a midsole half which has a heel region and a front edge extending at the rear of said metatarsal region of said upper.

16. The method as claimed in claim 12, wherein preparing the upper includes providing said front section of said upper with a toe region and a metatarsal region, said front stitching margin being provided solely at each of left and right sides of said metatarsal region of said upper.

17. The method as claimed in claim 16, wherein preparing the midsole includes providing said midsole with a toe region, a metatarsal region and a heel region, and wherein the stitching said front stitching margin, which is provided at each of the left and right sides of said metatarsal region of said upper, occurs to one of left and right sides of said outsole.

18. The method as claimed in claim 17, further comprising sewing a stitching end of said toe region to a peripheral end of said toe region of said midsole.

19. The method as claimed in claim 12, wherein preparing the outsole includes forming said front and rear sections of said outsole, into two separate pieces, where preparing the midsole includes providing said midsole with a front section corresponding to said front section of said outsole and a rear section corresponding to said read section of said midsole, and forming said rear section of said midsole as a separate piece from said front section of said midsole.

20. The method as claimed in claim 19, wherein preparing the upper includes providing said front section of said upper with a frontmost margin, said front stitching margin being provided at each of left and right sides of said front section of said upper and rearwardly of said frontmost margin, the method further comprising sewing said frontmost margin to said front section of said midsole.

* * * * *